US011913740B2

(12) United States Patent
Gagne et al.

(10) Patent No.: US 11,913,740 B2
(45) Date of Patent: Feb. 27, 2024

(54) FIRING PIN LOCK

(71) Applicant: Sig Sauer, Inc., Newington, NH (US)

(72) Inventors: Lucas Paul Gagne, Newmarket, NH (US); Aaron C. Sakash, Somersworth, NH (US); Bryan Charles Dustin, Strafford, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/950,456

(22) Filed: Sep. 22, 2022

(65) Prior Publication Data

US 2023/0102280 A1 Mar. 30, 2023

Related U.S. Application Data

(60) Provisional application No. 63/247,974, filed on Sep. 24, 2021.

(51) Int. Cl.
*F41A 17/66* (2006.01)
*F41A 19/30* (2006.01)

(52) U.S. Cl.
CPC ..... *F41A 17/66* (2013.01); *F41A 19/30* (2013.01)

(58) Field of Classification Search
CPC ..... F41A 17/24; F41A 17/64; F41A 17/66
USPC ..... 42/70.08
See application file for complete search history.

(56) References Cited

U.S. PATENT DOCUMENTS

| | | | | |
|---|---|---|---|---|
| 891,510 | A * | 6/1908 | Tansley | F41A 17/64 42/70.08 |
| 2,326,786 | A * | 8/1943 | Lochhead | F41A 19/40 89/1.3 |
| 2,848,832 | A | 8/1958 | Lee | |
| 4,192,236 | A * | 3/1980 | Scott | F42C 1/02 42/1.15 |
| 4,974,356 | A * | 12/1990 | Kelsey, Jr. | F41A 17/72 42/70.08 |
| 5,437,120 | A * | 8/1995 | Dornaus | F41A 21/488 42/70.08 |
| 5,778,587 | A | 7/1998 | Brandl et al. | |
| 6,145,234 | A | 11/2000 | Fluhr | |
| 8,074,553 | B1 | 12/2011 | Warren | |
| 8,245,427 | B2 | 8/2012 | Gomez | |
| 9,151,558 | B1 | 10/2015 | Hirt et al. | |
| 10,036,600 | B2 | 7/2018 | Maranli | |
| 10,309,739 | B2 | 6/2019 | Gomez | |
| 10,578,379 | B2 | 3/2020 | DeSomma | |
| 2021/0278158 | A1* | 9/2021 | Ellis | F41A 19/32 |

* cited by examiner

*Primary Examiner* — Bret Hayes
(74) *Attorney, Agent, or Firm* — Finch & Maloney PLLC

(57) ABSTRACT

A firing pin lock for firearms is provided. The firing pin lock is a single piece of resilient metal that includes a pocket for receiving the head of the firing pin to prevent inadvertent discharge of the firearm. The firing pin lock can be mounted laterally in the bolt carrier group and is deflected outwardly by the action of the hammer.

16 Claims, 5 Drawing Sheets

FIRING PIN LOCK

TECHNICAL FIELD

The present disclosure generally relates to firearms safety mechanisms. Specifically, the present disclosure is directed to a bolt-carrier group including a firing pin lock.

BACKGROUND

Many firearms include a firing pin that when caused or allowed to strike a primer initiates discharge of the firearm. It is important that the firing pin only strike the primer when the trigger is pulled intentionally. To prevent inadvertent or accidental discharge of the firearm, a safety or lock can be added to the firearm to prevent such discharge. For example, a safety or lock can be used to prevent disengagement of the sear or disconnect.

SUMMARY

In one aspect, a firearm is described, the firearm including a bolt carrier group that includes a bolt carrier and a firing pin, and a firing pin lock comprising a leaf spring, the leaf spring defining a pocket, the pocket configured and arranged to engage a head of the firing pin when an end of the leaf spring is in compression against the firing pin. The leaf spring can have a length and a width, the length greater than the width and wherein the leaf spring is oriented in relation to the firing pin at an angle that is closer to parallel than orthogonal. The firing pin lock can be mounted on a side quadrant of the bolt carrier. The firearm can include a retaining pin positioned to hold the firing pin lock in compression against the firing pin. The firing pin lock can be held in place by a single retaining pin. A portion of the leaf spring is planar and a portion of the leaf spring is curved. The firing pin lock can apply a spring force of greater than 0.2 lb and less than 2.0 lb laterally against the firing pin. The firearm can be an automatic firearm. A proximal end of the leaf spring can be curved outwardly from an axis of the firing pin whereas the leaf spring is deflected outwardly when struck by a hammer during a firing sequence. The pocket can include a distal surface that contacts a distal surface of a head of the firing pin to prevent forward movement of the firing pin.

In another aspect, a firing pin lock is described, the firing pin lock comprising a flexible leaf spring in mechanical communication with a firing pin, the leaf spring flexible in a horizontal axis. The leaf spring may be inflexible along a vertical axis and can be held in place by a retention pin. The retention pin can be in a vertical orientation and may be positioned to place the leaf spring in compression against a firing pin. The proximal end of the leaf spring can include a non-planar profile such as a curved profile where the amount of curvature is greater than two thicknesses of the leaf spring material. The curvature can be both longitudinally and laterally and can be spoon shaped. The distal end of the leaf spring can include a portion of the leaf spring that is looped back on itself. The proximal end of the leaf spring includes a pocket for contacting a distal surface of a head of a firing pin. The pocket can be a through hole.

The figures depict various embodiments of the present disclosure for purposes of illustration only. Numerous variations, configurations, and other embodiments will be apparent from the following detailed discussion.

DETAILED DESCRIPTION

In one aspect, a firing pin lock for an automatic weapon is disclosed. The firing pin lock can securely engage the firing pin to avoid inadvertent discharges, such as slamfire, which occurs when a round is unintentionally discharged upon chambering. The firing pin lock is disengaged from the firing pin when struck by the hammer and does not interfere with the performance of the firearm. The lock can withstand greater than 10,000, greater than 15,000 or greater than 20,000 rounds before failure. The lock can be mounted on the side of the bolt carrier group so that it can be installed and removed without needing to work around the gas key or operational rod ("op rod") that are typically positioned near the top of the bolt carrier group.

The firing pin lock can be a single integral piece of stiff but resilient material such as a metal leaf (flat) spring. The leaf spring can be held in position with a retaining pin that is seated in the bolt carrier. One portion of the leaf spring can include a pocket to retain the head of the firing pin when the leaf spring is in compression against the firing pin. The pocket can be, for example, a through hole, a slot, a recess, an indentation or a depression. The leaf spring can be easily replaced by simply removing the retaining pin and sliding out the leaf spring.

Overview

Figure 1:
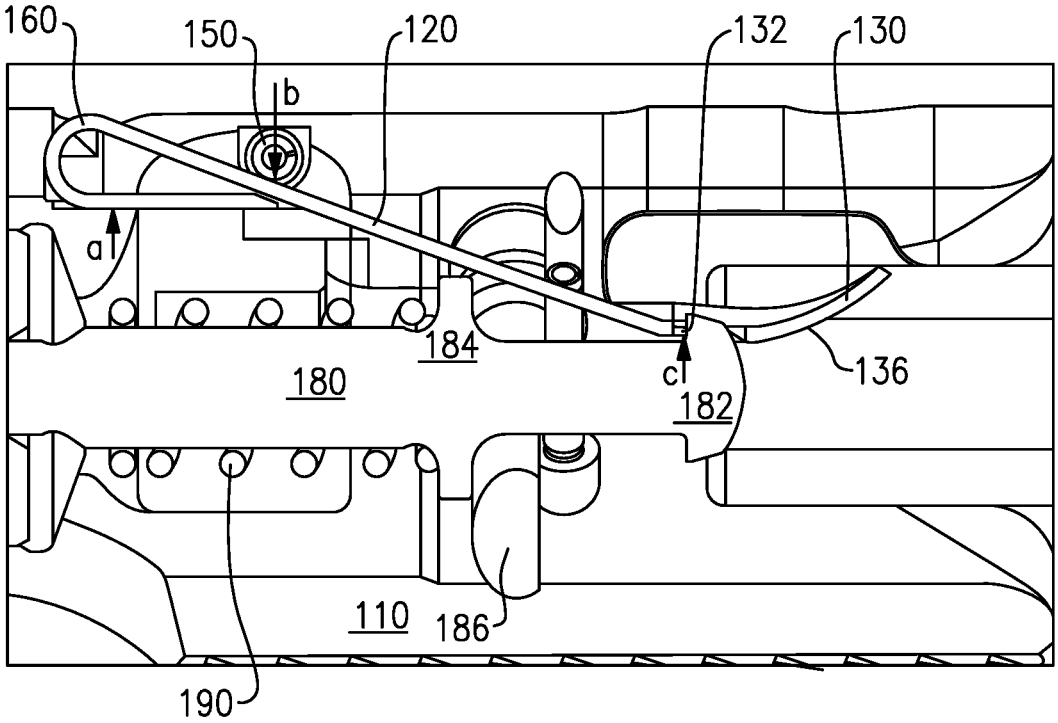
FIG. 1 is a cross-sectional view of a bolt carrier group including one embodiment of a firing pin lock.
Figure 2:
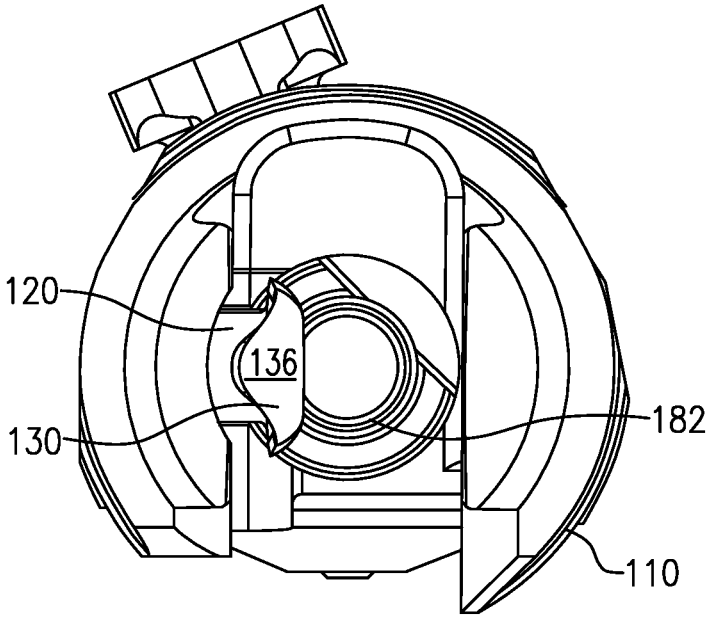
FIG. 2 is a rear profile view of the embodiment of FIG. 1.

FIG. 1 provides a longitudinal cross-sectional view of a bolt carrier group including a firing pin lock 120. The figure is positioned with the direction of fire to the left and is viewed from the bottom of the firearm when held in a standard firing position. As shown, firing pin lock 120 is on the left side of the bolt carrier 110. Firing pin 180 is held in place by firing pin retaining pin 186. Firing pin 180 includes firing pin head 182 that is struck by the hammer to initiate firing. Firing pin neck 184 serves as a stop and retainer for firing pin return spring 190 that is in compression to return firing pin 180 axially after it has been compressed by the action of the hammer during the firing sequence. FIG. 2 provides a profile view from the rear, proximal end of the bolt carrier group and shows the bolt carrier group in a standard upright position, with firing pin lock 120 on the left-hand side. If this view is divided into two side quadrants and two vertical quadrants, it can be seen that the lock, as shown, is positioned in the left, side quadrant. As viewed in FIG. 2, when the hammer falls, the firing pin lock 120 will be deflected by the hammer striking sloped surface 136, causing firing pin lock 120 to bend outwardly (to the left in FIG. 2) in a horizontal direction.

Figure 3:
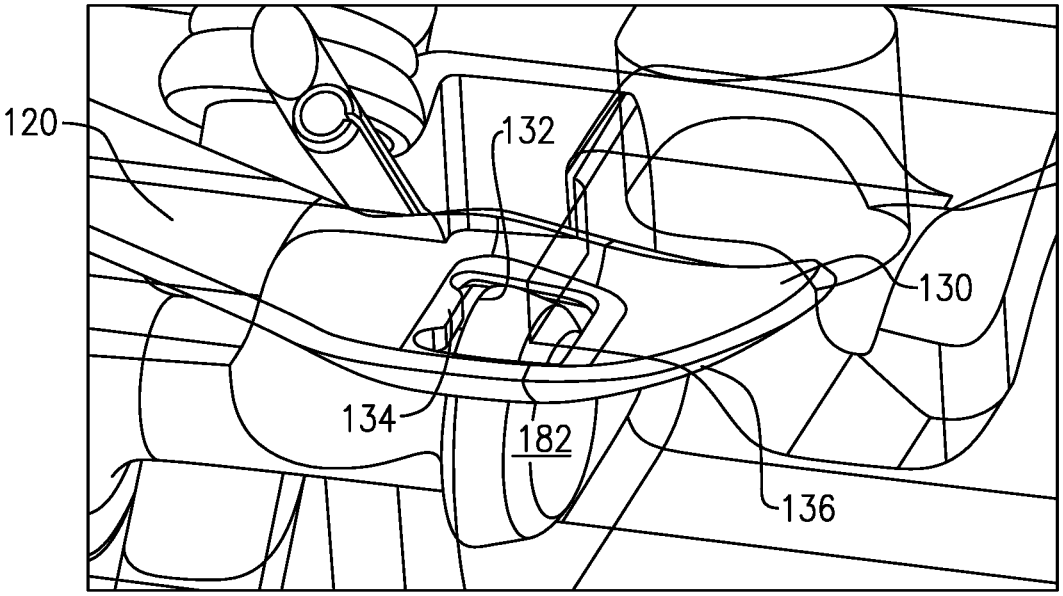
FIG. 3 is a profile view of the embodiment of FIG. 1 showing interaction of the firing pin and the firing pin lock.
Figure 4:
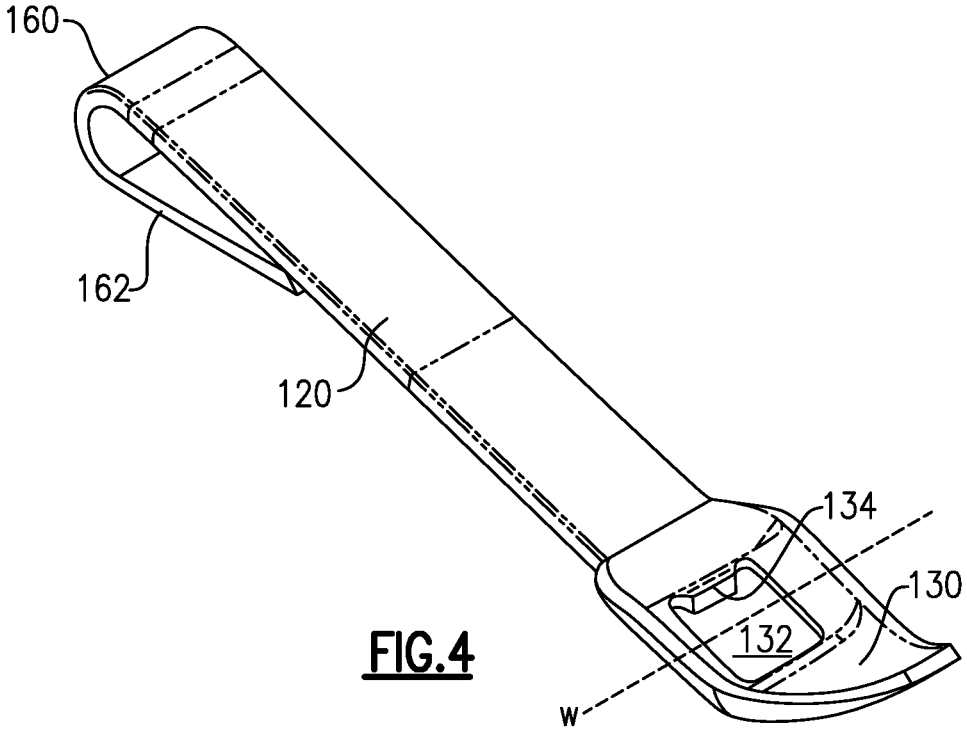
FIG. 4 is a profile view of one embodiment of a firing pin lock.

In the embodiment shown, firing pin lock 120 is comprised of a leaf spring that has been bent and die pressed into shape as shown. The leaf spring includes proximal end 130, distal end 160 and through hole 132 (FIGS. 3 and 4). Proximal end 130 is struck by the hammer (not shown) to release the head 182 of firing pin 180. Distal end 160 includes a loop in the leaf spring that is in direct contact with the bolt carrier 110. Vertically oriented lock retaining pin 150 (shown in FIG. 1) is positioned so that when inserted it forces leaf spring 120 to bend toward the central axis of the firing pin. The force shown as "b" is applied laterally by retaining pin 150 to leaf spring 120 which is pressured against firing pin 180 that applies a return force "c" against the leaf spring. As shown, bolt carrier 110 also applies a force "a" to the distal end of leaf spring 120. Leaf spring 120 is biased inwardly, toward the axis of the firing pin. As a result, leaf spring 120, that is naturally straight in an unbiased conformation, is bent about retaining pin 150 so that proximal end portion 130 applies a force inward toward the firing pin 180. The firing pin head 182 is retained by the through hole 132 in leaf spring 120. As can be seen more clearly in FIG. 3, distal edge 134 of through hole 132 will prevent any forward movement of firing pin 180 if there is any force, absent the hammer (slamfire), that propels the firing pin 180 toward the primer. Specifically, distal surface 134 will contact the distal surface of firing pin head 182 and prevent its movement forward (left, as shown). The two distal surfaces are at, or close to, right angles to the axis of firing pin 180, so any force applied by the firing pin to the distal surface 134 will not translate to an outward force that might release firing pin head 182 from through hole 132.

Function—

Figure 5:
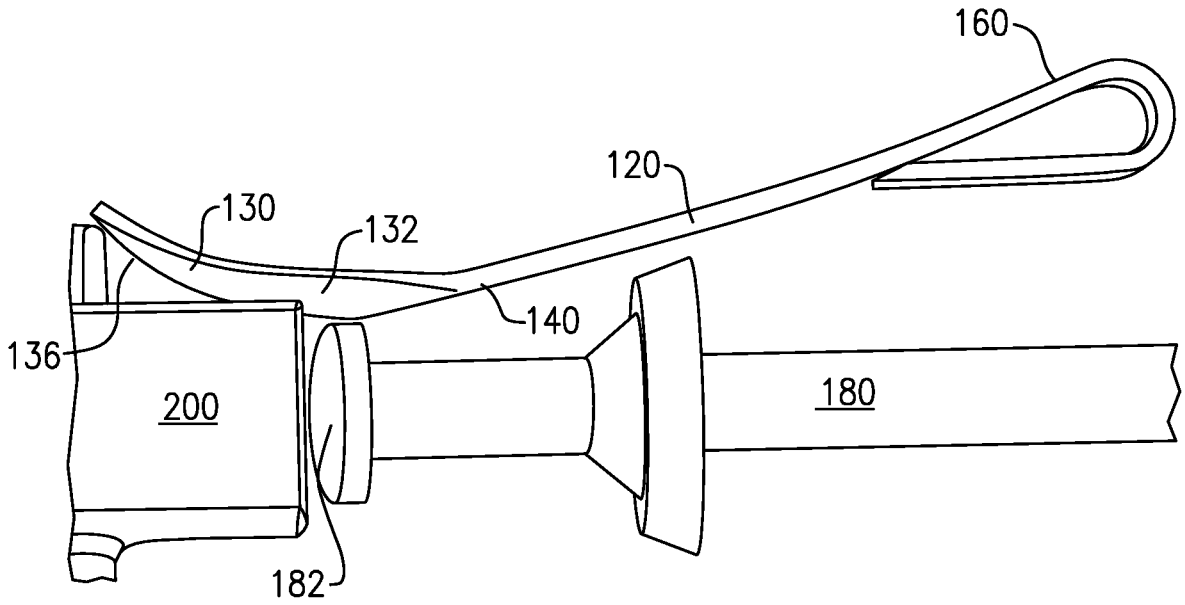
FIG. 5 provides a side profile view of an embodiment of a firing pin lock during the firing sequence.

When installed, as shown in the embodiment of FIGS. 1-4, pocket 132 is seated over firing pin head 182, preventing firing pin 180 from movement along the bore axis. Firing pin lock 120 is shifted to free the firing pin only during the shooting sequence when struck by the hammer. As shown in the top view of FIG. 5, as the hammer 200 moves from left to right it first encounters contact surface 136 of firing pin lock 120. Due to the curved profile of proximal end 130, leaf spring 120 is pushed laterally, away from firing pin 180, and pocket 132 clears firing pin head 182, freeing firing pin 180 for lateral movement. After the head of the firing pin is freed from the lock, hammer 200 continues its forward motion, striking the head of the firing pin. The firing pin is propelled forward, striking the primer and firing the weapon. After firing, the hammer retracts and the firing pin returns to its original position due to the lateral force provided by firing pin return spring 190. As firing pin 180 returns, firing pin head 182 contacts inner surface 140 of leaf spring 120 and pushes the leaf spring outwardly as the firing pin continues its rearward path. When the distal surface of firing pin head 182 passes distal surface 134 of pocket 132, firing pin head 182 passes into through hole 132 and leaf spring 120 moves back to its original, safe position until it is again struck by hammer 200. During the process of this embodiment, all movement of the firing pin lock occurs through bending of leaf spring 120. As shown, there are no mechanically connected joints and no translation of movement within the lock from one axis to another.

Structure—

Figure 7:
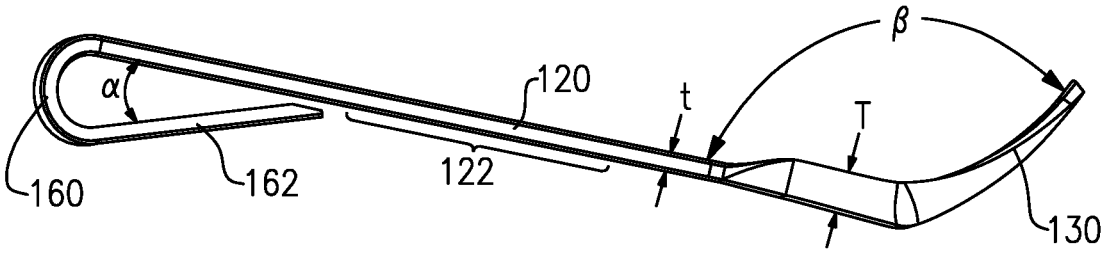
FIG. 7 provides a side view of the firing pin lock of FIG. 6.

As shown in FIGS. 1-5 the firing pin lock described herein can comprise, consist of, or consist essentially of a single piece. The single piece can be a leaf spring that has been stamped from sheet metal and shaped through one or more dies, for example. As illustrated in FIGS. 1 and 7, for example, a central portion of the firing pin lock can comprise a substantially straight, linear portion 122 that is structurally the same as when stamped from a sheet. In its installed position, linear portion 122 can be positioned at an angle to the axis of the firing pin of greater than 10 degrees, greater than 20 degrees or greater than 30 degrees. In other embodiments, this angle can be less than 60 degrees, less than 45 degrees or less than 30 degrees. Distal end 160 can be formed by looping the material back on itself to provide a curved end having flat planar portions extending from both sides of the loop. This loop portion may help distribute forces applied to lock 120 and can increase the life of the firing pin lock. In many embodiments the loop portion is bent but is not reshaped, so that it remains laterally flat. The loop may have a radius of curvature of less than 1 inch, less than 0.5 inch, less than 0.25 inch, greater than 0.1 inch, greater than 0.25 inch or greater than 0.5 inch. Inner loop leg 162 can have a length that is greater than 0.1, greater than 0.2, or greater than 0.3 times the full length of firing pin lock 120. In other embodiments, inner loop leg 162 can have a length of less than 0.5, less than 0.4 or less than 0.3 times the length of firing pin lock 129. Inner loop leg 162 (FIG. 7) can be at an angle to the central portion 122 of greater than 5 degrees, greater than 10 degrees, greater than 15 degrees, less than 90 degrees, less than 45 degrees or less than 30 degrees.

Figure 6:
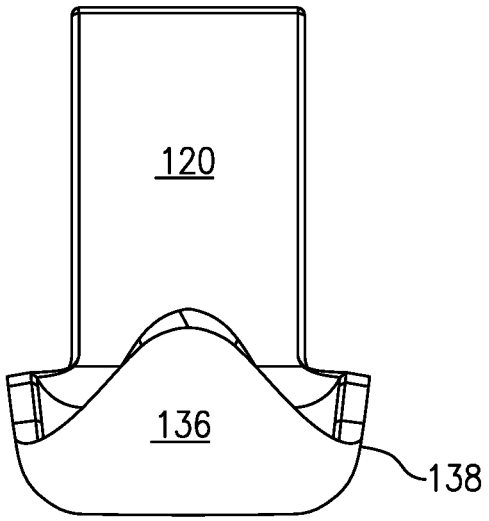
FIG. 6 provides a frontal view of one embodiment of a firing pin lock.

Proximal end 130, which contacts the hammer and retains the head of the firing pin, can be spoon shaped, as shown. As used herein, spoon shaped means that at least a portion of the firing pin lock is curved in both latitudinal as well as longitudinal axes. In different terms, at least a portion of the lock will be non-planar, e.g., convex, when viewed from both the front (FIG. 6) and from the side (FIG. 7). The amount of curvature can add to the strength of the spring and can vary depending on the material, material thickness and angle of impact of the hammer. As seen in FIG. 7, the thickness of a planar portion of the leaf spring can be represented as thickness "t." The total thickness of the proximal portion 130 is shown by thickness "T" which includes the thickness of the material as well as any upward curvature of the material. Although shown from the side (FIG. 7) and representing lateral curvature of the spring, thickness can also be measured from the front to determine longitudinal curvature of the spring. In various embodiments, the ratio of T to t for lateral and/or longitudinal curvature can be greater than 1:1, greater than 1.5:1, greater than 2:1, greater than 2.5:1. The T to t ratio can also be less than 10:1, less than 5:1 or less than 2:1.

Proximal end 130 can vary in its amount of curvature along its length. For example, a shallow spoon shape is shown in FIG. 1 while a more angular spoon shape is illustrated in FIG. 7. The angle of the proximal end 130 in relation to the central portion 122 of the firing pin lock can be represented by the angle β as shown in FIG. 7. Angle β is measured between the central portion 122 of the firing pin lock and the point on the proximal portion where the angle is greatest. For example, in FIG. 7 the angle is measured from the tip of the proximal portion to the planar portion in the central region 122. In other embodiments, for example when the proximal portion curves upwardly first and then downwardly before the terminus, the angle is measured from the inflection point where the angle is greatest. In some embodiments, the proximal portion can curve gradually along an arc while in others it can include one or more angles for a more angular appearance. Angle β can be, for example, less than 180 degrees, less than 170 degrees, less than 160 degrees, less than 150 degrees, less than 140 degrees, less than 130 degrees, less than 120 degrees or less than 110 degrees. The overall length of the proximal portion should be limited so as to avoid impact with the bumper during recoil. For example, the firing pin lock can be sized so that the tip of proximal portion 130 is positioned greater than 0.5 inch, greater than 1.0 inch or greater than 1.5 inch from the bumper.

As shown, the firing pin lock 120 includes a pocket for receiving the firing pin, specifically a portion of the head of the firing pin. The pocket can be a through hole, as shown, or can be an indent or recess that is capable of receiving the head of the firing pin. The embodiments described and shown in the figures illustrate a through hole, however those of skill in the art will understand that other embodiments utilizing, for example, a recess, will have analogous structures. Through hole 132 is big enough to receive a portion of firing pin head 182 so that the firing pin is locked from axial movement when forces other than a hammer strike, such as slamfire, are applied to the firing pin. When the pocket is a through hole it should not be so big however that the portions of the leaf spring adjacent the through hole are weakened. In some embodiments, the through hole (or pocket) can have a width that is less than the diameter of the head of the firing pin and greater than ¼ of the diameter of the firing pin. In the same and other embodiments, the width of the through hole 132 is less than 0.8, less than 0.75, less than 0.7, less than 0.65 or less than 0.6 of the total width of the firing pin lock 120 at the midpoint of the through hole 132. See dotted line "w" in FIG. 4. In the same, and other embodiments, the width of through hole 132 can be greater than 0.25, greater than 0.4, greater than 0.5 or greater than 0.6 of the total width of the firing pin lock 120 at a midpoint of through hole 132.

Distal pocket surface 134 can be an extended surface on the interior rim of the pocket or through hole. Distal surface 134 contacts the firing pin head in some embodiments and is therefore subject to wear. Distal surface 134 can be formed to be thicker than the width of the material that the firing pin lock is made from.

The lateral force of the firing pin lock 120 against the firing pin should be adequate to retain the firing pin but not great enough to interfere with the hammer. It has been found that a force of between 0.2 and 1.5 lbs. can secure the firing pin without causing excess wear of the leaf spring. In various embodiments, the force against the firing pin can be greater than 0.1, greater than 0.2, greater than 0.4, greater than 0.8 or greater than 1.0 lb. In other embodiments, the force can be less than 3, less than 2, less than 1.5 or less than 1.2 lb.

Material—

The firing pin lock can be made out of a single piece of material that is strong, flexible and resilient. For instance, the proximal portion will typically need to absorb up to 20,000 hammer strikes, and the main portion of the lock will be flexed an equal number of times, often at high frequency. In many embodiments the firing pin lock is made from metal, and specifically corrosion resistant metal such as stainless steel. In one set of embodiments, the firing pin lock is produced from 17-7 stainless steel. The thickness of the material can be selected to provide adequate strength and spring force while maintaining enough resiliency to last through 20,000 forceful impacts. The part can be stamped from sheet steel and then shaped by a die, such as a progressive die, that can be used to form a spoon shaped proximal portion. The loop at the distal portion can be formed by bending the steel around a mandrel. After the shape of the piece is complete, it can be heat treated to improve strength and resilience. Although the thickness of the leaf spring can vary along its length, in many embodiments it is of consistent thickness and is stamped from a steel sheet of constant thickness. Thickness can be, for example, less than 0.050 inch, less than 0.040 inch, less than 0.030 inch, less than 0.020 inch, greater than 0.010 inch, greater than 0.020 inch or greater than 0.030 inch. Specific thicknesses include, 0.015, 0.020, 0.025 and 0.030 inch.

Retaining Pin—

Figure 8:
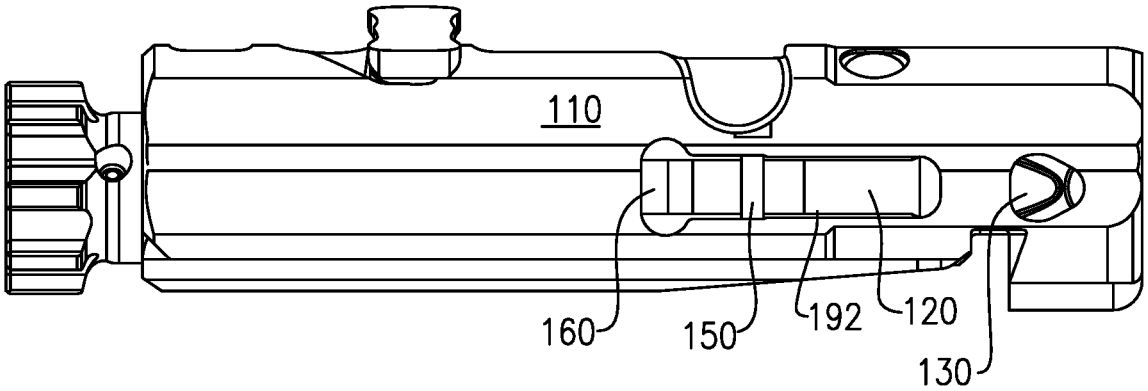
FIG. 8 provides a side view of a bolt carrier group including an installed firing pin lock of one embodiment.

The firing pin lock can be held in place by a single retaining pin 150. As shown in the top view of FIG. 1 and side view of FIG. 8, retaining pin 150 is oriented vertically and is received through an orifice in the bolt carrier and seated in an opposing hole at the opposite side (top or bottom) of the bolt carrier 110. The retaining pin can be any retainer that allows for the retention and removal of the firing pin lock. The retention pin should be secure so as not to loosen or fall out during extensive automatic fire. Preferably, the retaining pin presents a smooth rather than a sharp surface to contact the firing pin lock so that the firing pin lock, which bends around the retaining pin, is not subjected to extremely localized bending at that point. In various embodiments, the retaining pin can be a screw, a bar, a slotted pin, a friction pin or a pin including a detent ball. To install the firing pin lock, the weapon is turned on its side with installation window 192 facing up. See FIG. 8. The leaf spring is placed into the carrier so that the through hole 132 receives the firing pin head 182. Using a tool or finger, the leaf spring is compressed to provide room for the retaining pin to be slid into place. After the retaining pin is in place, the pin itself forces the leaf spring into compression, keeping through hole 132 around firing pin head 182. To release the leaf spring, the retaining pin is simply removed and the leaf spring follows.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A firearm comprising:

a bolt carrier group including a bolt carrier and a firing pin; and a firing pin lock comprising a leaf spring, the leaf spring defining a pocket, the pocket configured and arranged to engage a head of the firing pin when an end of the leaf spring is in compression against the firing pin.

2. The firearm of claim 1 wherein the leaf spring has a length and a width, the length greater than the width and wherein the leaf spring is oriented in relation to the firing pin at an angle that is closer to parallel than orthogonal.

3. The firearm of claim 1 wherein the firing pin lock is mounted on a side quadrant of the bolt carrier.

4. The firearm of claim 1 comprising a retaining pin positioned to hold the firing pin lock in compression against the firing pin.

5. The firearm of claim 1 wherein the firing pin lock is held in place by a single retaining pin.

6. The firearm of claim 1 wherein a portion of the leaf spring is planar and a portion of the leaf spring is curved.

7. The firearm of claim 1 wherein the firing pin lock applies a spring force of greater than 0.2 lb and less than 2.0 lb laterally against the firing pin.

8. The firearm of claim 1 wherein the firearm is an automatic firearm.

9. The firearm of claim 1 wherein a proximal end of the leaf spring is curved outwardly from an axis of the firing pin whereas the leaf spring is deflected outwardly when struck by a hammer during a firing sequence.

10. The firearm of claim 1 wherein the pocket includes a distal surface that contacts a distal surface of a head of the firing pin to prevent forward movement of the firing pin.

11. A firing pin lock comprising:

a flexible leaf spring in mechanical communication with a firing pin, the leaf spring flexible in a horizontal axis wherein a proximal end of the leaf spring has a non-planar curved profile and the amount of curvature is greater than two thicknesses of the leaf spring material.

12. The firing pin lock of claim 11 wherein a proximal end of the leaf spring includes curvature both longitudinally and laterally.

13. The firing pin lock of claim 11 wherein a distal end of the leaf spring includes a portion of the leaf spring that is looped back on itself.

14. The firing pin lock of claim 11 wherein the proximal end of the leaf spring includes a pocket for contacting a distal surface of a head of a firing pin.

15. The firing pin lock of claim 14 wherein the pocket comprises a through hole.

16. The firing pin lock of claim 11 wherein the proximal end of the leaf spring is spoon shaped.

* * * * *